United States Patent [19]

Musschoot

[11] Patent Number: 4,718,473

[45] Date of Patent: Jan. 12, 1988

[54] VIBRATORY STRESS RELIEF APPARATUS

[75] Inventor: Albert Musschoot, Barrington, Ill.

[73] Assignee: General Kinematics Corporation, Barrington, Ill.

[21] Appl. No.: 915,864

[22] Filed: Jul. 30, 1986

Related U.S. Application Data

[63] Continuation of Ser. No. 695,076, Jan. 25, 1985, abandoned.

[51] Int. Cl.[4] ..... B22D 29/00

[52] U.S. Cl. ..... 164/132; 164/260; 164/345; 164/404; 148/12.9

[58] Field of Search ..... 51/6, 7; 264/334; 148/12.9; 164/131, 132, 260, 344, 345, 346, 401, 404

[56] References Cited

U.S. PATENT DOCUMENTS

| | | | |
|---|---|---|---|
| 2,284,671 | 6/1942 | Meinzer | 51/7 |
| 2,353,492 | 7/1944 | O'Connor | 164/260 |
| 2,912,803 | 11/1959 | Simjian | 51/7 |
| 4,323,106 | 4/1982 | Bayliss | 164/401 |

FOREIGN PATENT DOCUMENTS

| | | | |
|---|---|---|---|
| 2088269 | 6/1982 | United Kingdom | 148/12.9 |

*Primary Examiner*—Nicholas P. Godici
*Assistant Examiner*—Richard K. Seidel
*Attorney, Agent, or Firm*—Wood, Dalton, Phillips, Mason & Rowe

[57] ABSTRACT

A vibratory stress relief apparatus is provided and has a resiliently supported base and an adjustable rate vibratory member on the base. A housing having a support plate and spaced side walls is resiliently supported on the base. A casting rests in the housing with a closure secured to the support plate in spaced relation to the casting. Shims are provided for positioning the closure a predetermined distance from the casting whereby the vibratory member will vibrate the housing and the casting and will hammer and rattle the casting between the closure and the support plate to relieve stresses in the casting and to clean sand and other impurities from the internal and external surfaces of the casting.

7 Claims, 5 Drawing Figures

VIBRATORY STRESS RELIEF APPARATUS

This application is a continuation of application Ser. No. 695,076, filed Jan. 25, 1985, now abandoned.

DESCRIPTION

Technical Field

This invention relates to an apparatus and method for vibratory stress relieving internal stress patterns in castings, forgings and/or welded fabrications.

BACKGROUND OF THE INVENTION

An age old problem in the metal casting industry is the presence in the casting of stresses which distort the shape of the casting and can cause brittle fracture or stress corrosion in the part. Up until the last two decades, the only known effective way to stress relieve the part was by thermal stress relief. This entailed loading the part or parts into an oven or onto a conveyor traveling through an oven where the part or parts were heated to elevated temperatures for an extended period of time and cooled also over an extended period of time. The extent of the heating and cooling and the length of time involved is dependent upon the type of material, size of the part, intricacy of the part and the like.

The effect of thermal or heat treatment is dimensional stability and stress reduction but it can significantly alter the metallurgy of the part and can cause scaling and discoloration. The altered metallurgy will generally avoid brittle fracture, stress corrosion and creep.

Thermal treatment of material is expensive, requiring large consumption of fuel, substantial outlay for equipment and floor space and a long time for effecting the process. The expenditure is particularly wasteful where the only stress needed to be treated is in the field of shape stabilization.

A system of vibratory stress relief was devised within the last two decades where castings can be shape stabilized by inducing one or more vibrating states using a high force exciter. The high force exciter causes the structure to undergo overall elastic distortion such as might be obtained by loading it mechanically, except that the loading modes induced by vibration are generally more complex and variable than could be achieved by externally applied static forces. The manually applied strains cause regions of internal stress to give rise to local plasticity where the sum of the internal and vibratory induced strains exceed the yield point. The plasticity causes a redistribution and reduction in internal stress. The existent vibratory stress relief equipment use AC or DC vibrators which operate from 0 to 200 Hz and apply a full frequency range to the part, which part is isolated from the ground on resilient pads. The equipment has been successful in reducing costs, eliminating scaling and discoloration and resulted in the parts being stress relieved within the field of shape stabilization. However, the equipment does not clean the casting during the application of the stress relieving vibratory force.

THE INVENTION

An apparatus and method have been devised that provides an improved vibratory stress relief for castings while at the same time cleaning loose material, such as casting sand, from the casting. The apparatus includes an adjustable vibrator for vibrating a resiliently supported housing in which a casting is positioned for limited and controlled rattling or hammering type motion between the cover and the support plate of the housing. The gap between the casting and the housing is controlled such that with the vibrator in operation the internal stressed areas or points or stress concentration in the casting are acted upon by the applied impacts of the apparatus resulting in a redistribution of and a reduction in internal stress. The casting with redistributed and reduced internal stresses is rendered shape stable so that it can be machined, bored and the like without the machined surfaces, bores or the like becoming distorted due to unrelieved internal stresses.

The castings treated with the improved vibratory apparatus have all the advantages of the castings treated in existent vibratory stress relief equipment; namely, less expensive than thermal stress relief, stress relieved quicker than thermal stress relief, and less complicated than thermal stress relief while at the same time being more readily usable on large castings. The hammering or rattling type vibratory action working on the casting in the controlled gapped housing applies strains more widespread and more uniform to the casting resulting in a more completely stress relieved casting. The vibratory action will simultaneously loosen and discharge any impurities, such as sand or scale, that may have clung to the casting.

The apparatus has a pair of independently driven but self-synchronizing eccentric vibrators which are mounted on a base member resiliently supported on a bearing surface. A housing is supported resiliently on the base member and has an impact zone in the housing for supporting a casting. A reinforced closure is secured to the housing over the casting in the impact zone and is supported in predetermined spaced relation to the casting. The vibrators vibrate the housing whereupon the casting will hammer or rattle between the housing and the closure. The casting being subjected to the vibratory motion and the hammering/rattling motion receives applied strains which redistribute and reduce internal stresses in the casting. The vibratory action will also loosen and discharge any impurities on the external or internal surfaces of the casting. The treatment of the casting reduces internal stresses so that subsequent machining operations will produce machined surfaces which will have stable dimensions not likely to distort due to internal unrelieved stresses.

PREFERRED FORM OF THE EMBODIMENT

Figure 1:
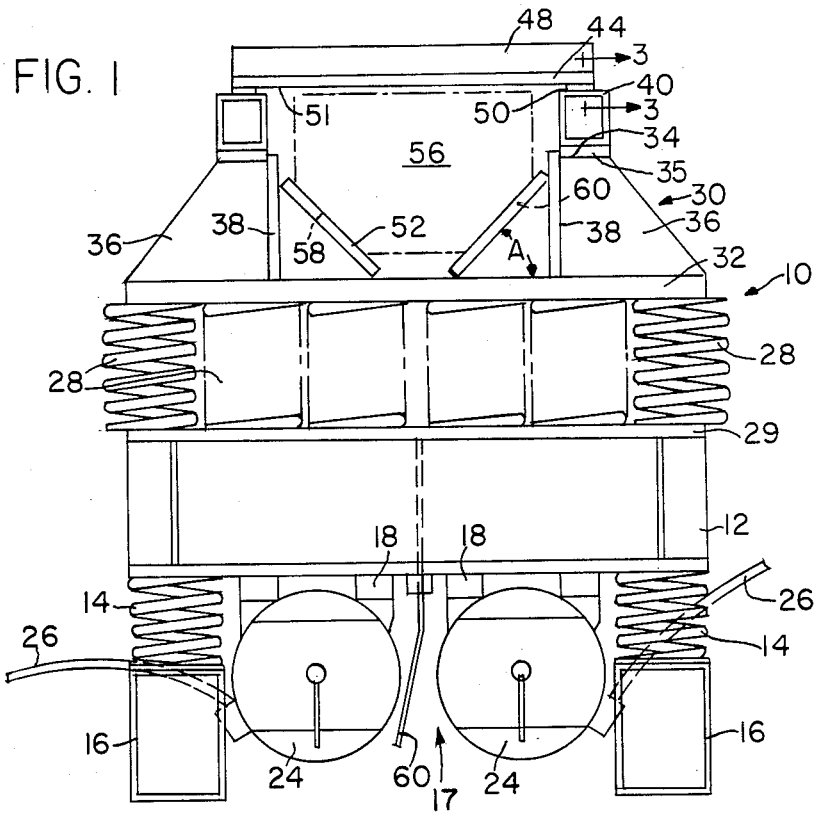
FIG. 1 is an end elevational view of the vibratory stress relieving apparatus.
Figure 2:
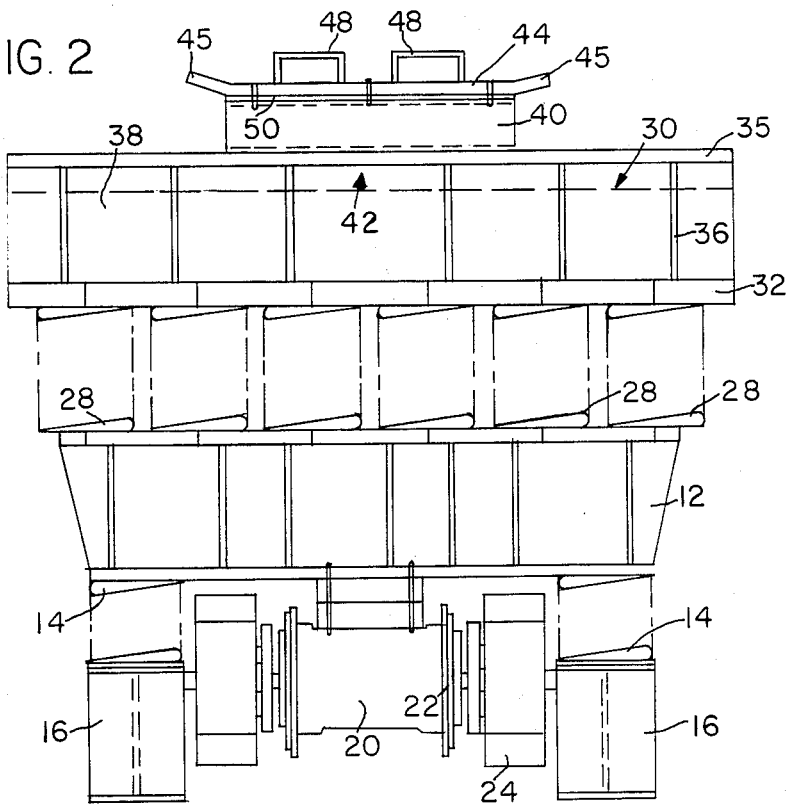
FIG. 2 is a partial side elevational view of the apparatus of FIG. 1.
Figure 3:
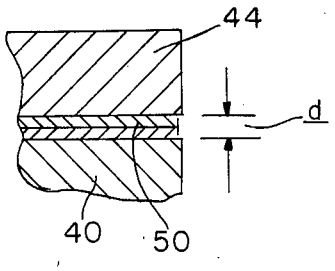
FIG. 3 is an enlarged partial cross-sectional view taken along the line 3—3 of FIG. 1.

The preferred form of the invention is shown in FIGS. 1, 2 and 3 wherein a vibratory stress relieving apparatus 10 is illustrated and includes a reinforced base portion 12 which is resiliently mounted on spring members 14 located at each corner thereof. The spring members 14 are supported on posts 16, which in the illustrated form are rigidly secured to a bearing surface such as a concrete floor or the like. An adjustable rate eccentric apparatus 17 is mounted on the base by means of a pair of mounting brackets 18 secured to the undersurface of the base 12 in symmetrically spaced relationship with respect to the center line of the apparatus. Each bracket 18 supports a motor 20, which has a double-ended shaft 22 extending therethrough, upon each end of which is mounted an eccentric member 24. The speed of each motor 20 and the radial location of the center of gravity of each eccentric member 24 relative to the shaft 22 is adjustable creating the adjustable rate eccentric apparatus 17. The adjustable rate eccentric apparatus 17 will not be described in detail since any one of several commercially available units can be used; for instance, the unit of the type shown and described in Musschoot U.S. Pat. No. 4,168,774, wherein the speed of the motor and the amplitude of vibrations generated by the location of the center of gravity of the eccentric member 24 is adjusted from a remote control panel through connections 26. Each motor 20 and its associated eccentric members 24 is independently driven but will self-synchronize with respect to the other motor and eccentrics in producing the variable rate vibratory motion for the apparatus.

A plurality of equally spaced, uniformly positioned springs or resilient members 28 are secured to the top wall 29 of the base 12 and support a plate 32 secured to the springs. The plate 32 has a pair of upright gusseted reinforced walls 38 which combine with the plate 32 to form a channel shaped housing 30. The upper edge 34 of the gussets 36 are cropped and rigidly support horizontal mounting walls or supports 35. As can best be seen in FIG. 2, the plate or bottom wall 32 and the side walls 38 extend outwardly from the base 12 in overhanging relation with respect to the springs 28 and support posts 16.

A closure member 44 is removably attached as by bolts or the like to spacer bars 40 which in turn are attached as by bolts or the like to the mounting walls or supports 35 on the side walls 38 of the housing. The height of the spacer bars 40 is selected for each style casting being worked on. The idea being to have the top surface of the bars close enough that shims 50 can easily provide the fine spacing needed. The closure covers only a midportion 42, to be known as the impact portion, of the housing and is substantially centered with respect to the base. One or more reinforcing beams 48 extend from one side to the other of the closure member 44 and are rigidly secured to the member 44 so as to add rigidity to the closure member. The closure member 44 has upturned end portions 45, see FIG. 2, which acts as guides for the castings being cleaned and stress relieved. Shims 50 are positioned between the closure 44 and the spacer bars 40 on the side walls 38 of the housing for reasons and purposes that will be described in detail hereinafter.

Within the housing 30 is mounted a pair of impact plates 52 which, in the form of the invention shown in FIGS. 1–3, are affixed at particular angles extending diagonally across the corners of the housing and extending from one end of the housing to the other. The plates 52 and the angle A at which the plates are mounted with respect to the plate 32 of the housing are pre-established by the particular shape of the casting being worked upon. In the case of the form of the invention illustrated in FIG. 1, a casting 56 of a particular automobile engine block is the article being worked upon. In this case, the angle A would be the angle that the plane of the cylinder head makes with the horizontal plane of the block. With the plates 52 in place, the two surfaces 58 and 60 of the block 56 (which surfaces contain the entrances to the cylinder bores) rest substantially flush against the plates 52.

An important aspect of the invention is to provide a gap d of predetermined size between the casting 56 and the closure 44 when the casting is at rest in the housing. The most efficient gap depends on the stroke of the vibratory apparatus which may be varied by changing the motor speed and/or by changing the degree of eccentricity or degree of unbalance brought about by changing the location of the center of gravity of the eccentric weights with respect to the axis of the motor. It can be shown that the theoretical size of the gap d can be calculated using the size of the stroke and the coefficient of restitution. The size of the gap is not dependent upon frequency. To provide the desired gap d, a shim or shims 50 are provided between the walls or supports 35 on the side walls 38 of the housing and the undersurface 51 of the cover 44 so that the spacing between the undersurface of the cover 44 and the casting falls within the range of the desired gap dimension d. Adjusting the stroke can control the apparatus to provide maximum impact action (maximum efficiency). Since the gap is a function of the stroke, adjusting the stroke can maximize the efficiency of the apparatus.

An adjustable rate feeder (not shown) is provided which is controlled by air administered through air hose 60 (FIG. 1) such that when a casting 56 is placed on the support plates 52 at the open topped end of the housing 30 it can be fed into the covered or impact portion of the housing using the adjustable rate feeder. The feeder is shut off when the casting is in position in the impact zone, whereupon the vibratory apparatus is energized. The vibratory apparatus will apply vibratory forces to the housing 30, which will cause the casting to vibrate as well as hammer and rattle between the plates 52 and the cover 44. The vibratory force generated by the vibrators can be adjusted to provide the appropriate vibratory hammering and rattling motion to the casting, which will cause the internal stresses or points of stress concentration to be redistributed resulting in a reduction in the internal stresses in the casting as well as cleaning the casting by loosening sand, scale and the like and flushing it from the internal and external surfaces of the casting. The result of the vibratory hammering and rattling is to modify the internal stress patterns so as to produce shape stabilization of the casting. The induced vibration of the metal casting will stress relieve the locked in stresses. The vibratory stress relief can be applied to the casting at any stage in the processing of the casting once the casting has solidified. The time involved in stress relieving for shape stabilization is a very short time compared to the hours and days that it would take to stress relieve the casting by thermal stress relief procedures. The apparatus provides uniform application of vibratory hammering and rattling to the whole casting so as to uniformly stress relieve the part. Since the gap may vary from casting to casting, even though the castings are essentially the same, the stroke can be adjusted within limits to control the machine for maximum effectiveness. With the two mass system employed herein, the stroke can be adjusted by varying the speed and/or by varying the eccentricity. The apparatus vibrates the casting such that each and every element of the part vibrates at its natural frequency to reduce the internal stresses.

In a successfully operated apparatus, standard castings for V-6 blocks were conveyed into the impact zone of the apparatus. The apparatus was driven at a frequency of 1800 cycles per minute with the gap "d" set within the range of 0.2" and 0.4" and the stroke was maintained at 0.4". The castings treated in this apparatus were found to be stress relieved and clean. The treatment took only a few minutes and was more effective than prior stress relieving apparatus of the AC vibrator type.

Figure 4:
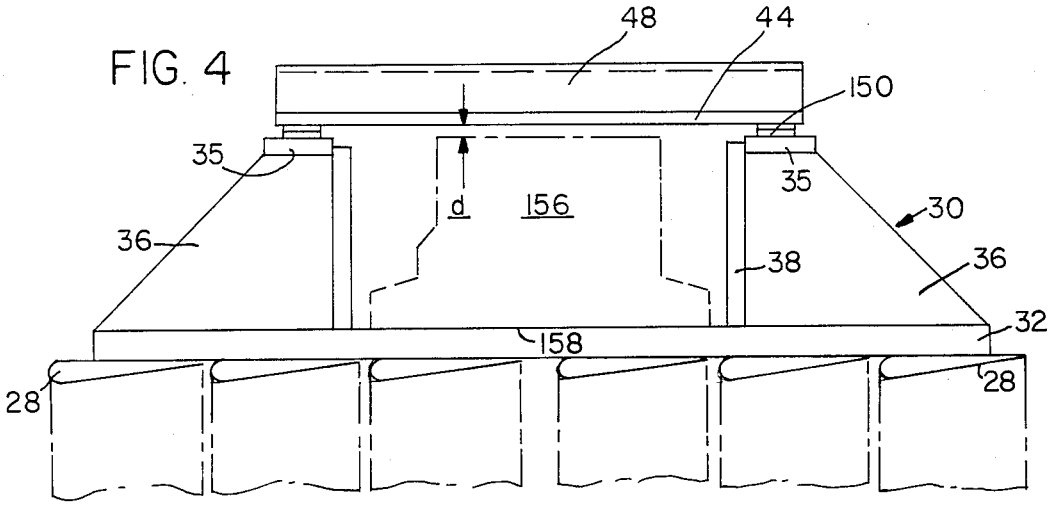
FIG. 4 is a partial end elevational view showing a modified form of housing for the vibratory stress relieving apparatus.
Figure 5:
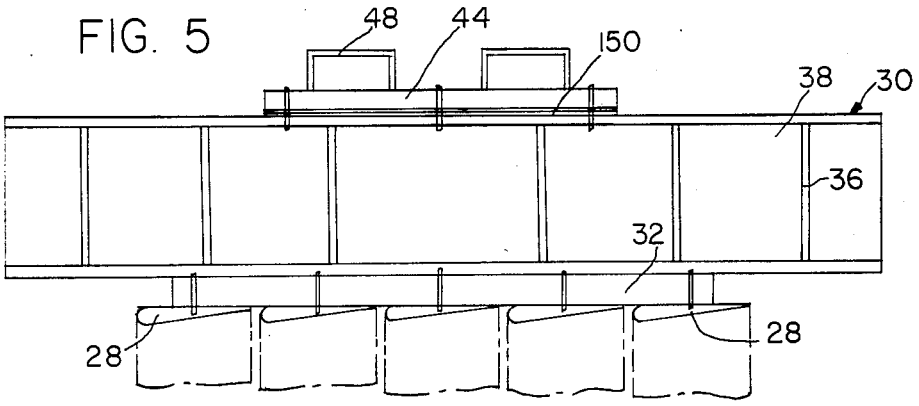
FIG. 5 is a partial side elevational view of the modified form of the apparatus shown in FIG. 4.

The modification shown in FIGS. 4 and 5 have common elements with the apparatus of FIGS. 1–3 except that the impact plates 52 are coextensive with the bottom wall or plate 32. An engine block casting 156 of a shape different from the casting 56 of FIGS. 1–3 has a planar surface 158 which contains the entrances to the cylinder bores extending transverse to the planar surface 158. The surface 158 lies flush with the plate 32 and is fed into the covered impact portion of the housing by appropriate means such as an adjustable rate feeder (not shown). Since the height of the casting 156 is smaller than casting 56, it is not necessary to use spacer bars 40. The gap d is established by placing appropriate shims 150 between the closure 44 and the walls 35. The operation of the vibratory stress relieving apparatus of FIGS. 4 and 5 is the same as for the apparatus of FIGS. 1–3.

I claim:

1. In a vibratory stress relief apparatus for a casting or the like, said apparatus comprising a base resiliently supported on a bearing surface, vibratory means carried by said base, a housing having a support plate on which the casting is positionable, resilient means supporting said housing on said base, closure means secured to the housing, and means for selectively positioning said closure means on the housing a predetermined distance from the top of the housing, said means for selectively positioning comprising a plurality of shims which can be placed selectively individually and in stacked relationship between the closure means and housing to thereby produce a desired optimum gap between the closure means and the casting, whereby said vibratory means will vibrate said housing and will hammer and rattle the casting between the closure means and the support plate to stress relieve and to clean said casting.

2. In the vibratory stress relief apparatus as claimed in claim 1 wherein each said shim has a thickness calculated from the stroke and eccentricity of the vibratory means so that the shims used selectively alone and in stacked relationship produce an optimum gap.

3. In the vibratory stress relief apparatus as claimed in claim 1 wherein said vibratory means is a variable rate means whereby the amplitude of the vibrations generated by the vibratory means can be varied.

4. A method of vibratorily relieving stress in a casting or the like, comprising the steps of:

providing a vibratory housing with a support plate on which the casting is positionable and a closure means at the top of the housing;

positioning the casting on the support plate of the housing;

determining an optimum gap between the bottom of the closure means and the top of the casting, whereby the vibratory housing will hammer and rattle the casting between the closure means and the support plate to stress relieve and to clean the casting; and selectively positioning the closure means on the housing a predetermined distance from the top of the housing to define said gap.

5. A method of vibratorily relieving stress in a casting or the like, comprising the steps of:

providing a vibratory housing with a support plate against which the casting is positionable and a closure means at a side of the housing opposite the support plate;

positioning the casting against the support plate of the housing;

determining an optimum gap between the inside of the closure means and the adjacent side of the casting, whereby the vibratory housing will hammer and rattle the casting between the closure means and the support plate to stress relieve and to clean the casting; and selectively positioning the closure means on the housing a predetermined distance therefrom to define said gap.

6. In a vibratory stress relief apparatus for a casting or the like, said apparatus comprising a base resiliently supported on a bearing surface, vibratory means carried by said base, a housing having a support plate against which a casting is positionable, resilient means supporting said housing on said base, closure means secured to the housing and having an inside surface, and means for selectively positioning said closure means on the housing a predetermined distance from the housing, said means for selectively positioning comprising a plurality of shims which can be placed selectively individually and in stacked relationship between the closure means and the housing to thereby produce a desired optimum gap between the inside surface of the closure means and an adjacent side of the casting, whereby said vibratory means will vibrate said housing and will hammer and rattle the casting between the inside surface of the closure means and the support plate to stress relieve and to clean said casting.

7. A method of vibratorily relieving stress in a casting or the like, comprising the steps of:

providing a vibratory housing with a first wall surface;

providing a closure with a second wall surface facing the first wall surface and in spaced relationship therewith;

placing a workpiece between the first and second wall surfaces;

determining an optimum gap between a workpiece and one of the first and second wall surfaces with the workpiece against the other of the first and second wall surfaces;

selectively positioning the second wall surface relative to the first wall surface so that said optimum gap is established; and vibrating the housing so that the casting will be hammered and rattled between the first and second wall surfaces to stress relieve and clean the casting.

* * * * *